US005482225A

United States Patent [19]

Hartwig et al.

[11] Patent Number: 5,482,225

[45] Date of Patent: Jan. 9, 1996

[54] PROCESS FOR LOADING A PROCESSING MACHINE HAVING A FINE CENTERING STEP AND APPARATUS FOR THIS PURPOSE

[75] Inventors: Thomas Hartwig, Egnach; Georg Laager, Turbenthal; Ingomar J. K. Summerauer, Arbon, all of Switzerland

[73] Assignee: Bruderer AG, Switzerland

[21] Appl. No.: 198,534

[22] Filed: Feb. 18, 1994

Related U.S. Application Data

[63] Continuation of Ser. No. 46,359, Apr. 8, 1993, abandoned, which is a continuation of Ser. No. 775,277, Oct. 11, 1991, abandoned.

[30] Foreign Application Priority Data

Oct. 12, 1990 [CH] Switzerland ..... 3286/90

[51] Int. Cl.[6] ..... B65H 19/12; B65H 23/02

[52] U.S. Cl. ..... 242/559.4; 242/563.1; 242/597.7

[58] Field of Search ..... 242/57.1, 57, 78.6, 242/78.8, 105, 55, 79, 58, 58.6, 563.1, 592, 597.7, 559.4, 418.1, 420.6

[56] References Cited

U.S. PATENT DOCUMENTS

| | | | |
|---|---|---|---|
| 2,871,013 | 1/1959 | Markey | 242/563.1 |
| 3,411,728 | 11/1968 | Hall et al. | 242/55 |
| 3,583,310 | 6/1971 | Blough | 100/4 |
| 3,810,591 | 5/1974 | Haven | 242/78.6 |
| 4,058,270 | 11/1977 | Simmons et al. | 242/105 |
| 4,304,370 | 12/1981 | Box et al. | 242/78.6 |
| 4,863,112 | 9/1989 | Summerauer et al. | 242/79 |

FOREIGN PATENT DOCUMENTS

| | | | |
|---|---|---|---|
| 0132819 | 2/1985 | European Pat. Off. . | |
| 0267357 | 5/1988 | European Pat. Off. . | |
| 2340149 | 9/1977 | France . | |
| 1208145 | 12/1965 | Germany . | |
| 1209842 | 1/1966 | Germany . | |
| 1296475 | 5/1969 | Germany . | |
| 43689 | 7/1963 | Luxembourg . | |
| 1357523 | 6/1974 | United Kingdom | 242/563.1 |
| 8703517 | 6/1987 | WIPO . | |
| 9009945 | 9/1990 | WIPO . | |

*Primary Examiner*—John M. Jillions
*Attorney, Agent, or Firm*—Ostrolenk, Faber, Gerb & Soffen

[57] ABSTRACT

An unwinding station in which a coil of band-like material is unwound with a vertical axis, i.e. lying in a horizontal plane, is provided for loading a processing machine with the band-like material from the coil. Consequently, the band taken off from it is in a vertical plane and, for insertion into a processing machine, must be turned in a turning zone. A centering device is provided for centering the band with respect to the central axis of the processing machine, in order to avoid internal stresses in the band before the band is turned.

18 Claims, 9 Drawing Sheets

PROCESS FOR LOADING A PROCESSING MACHINE HAVING A FINE CENTERING STEP AND APPARATUS FOR THIS PURPOSE

This is a continuation of application Ser. No. 08/046,359 filed Apr. 8, 1993, now abandoned, which is a continuation of application Ser. No. 07/775,277, filed on Oct. 11, 1991, now abandoned.

The invention relates to a process and apparatus for loading a processing machine with a band-like material and for finely centering the material.

A process of this type is disclosed in U.S. Pat. No. 4,863,112, which corresponds to EP-A-0 267 357. There, the coil is placed with the vertical axis on a rotatable surface or on a turntable, the beginning of the band is then taken off and the band is then turned through 90+ so that it comes to rest in an approximately horizontal plane and the band is finally centered on an axis predetermined by the processing machine.

The operations according to FR-A-2 340 149 took place similarly but manually; in said FR-A, a hand-operated turning means having a downstream, driven pair of rollers formed the take-off and turning means but, because of the arrangement chosen, an uncentered position of the coils was deliberately chosen as the starting point since a certain angle with respect to the level of the coils was-thought to be expedient.

Although this process and its associated apparatus generally also proved suitable in practice, the workpieces produced in the processing machine occasionally exhibited internal stresses which, in the case of demanding products, can have unpleasant effects. Of course, the origin of such internal stresses is difficult to determine since they can be introduced even during production of the band-like material, in general sheet metal strips, or during winding of the coil, etc. A so-called straightening machine is therefore generally located upstream of the processing machine and, by shaping the band between intermeshing rollers, eliminates these stresses. Another, occasional phenomenon comprised one-sided wear of band guides arranged after the centering zone.

It is true that those skilled in the art were not unaware of these deficiencies in the past, as shown, in particular, by the introductory part of U.S. Ser. No. 539,818 (filed Apr. 4, 1966), which corresponds to DE-B-1 296 475. However, the achievement according to the specification likewise involved only coarse centering since only the position of a single edge of the band was taken into account. In general, however, coils having different band widths are processed, so that the central axis of the band—only one edge thereof when fixing the position—will deviate from a desired position corresponding to the machine axis, depending on the band width. For this reason, the long-known disadvantages could not be eliminated even by this design.

The invention starts, in a first step, from the knowledge that at least some of the phenomena described above may be due to the centering, and this gives rise to the object which is to provide an improved centering process, to make the plant cheaper and to permit a shorter length. This is achieved in a surprisingly simple manner by the features disclosed herein.

While the end of the band-like material at the coil is determined in the known process by the position of the coil and may be determined by clamping surfaces gripping the band, and good centering is therefore hindered, this effect is prevented by the measure according to the invention. Advantageous embodiments of the invention are described herein.

Reliable operation of a band-clamping means on a coil in an unwinding station can be achieved by an apparatus as disclosed herein.

Further details of the invention are given in the following description of embodiments described with reference to the drawing.

Figure 6:
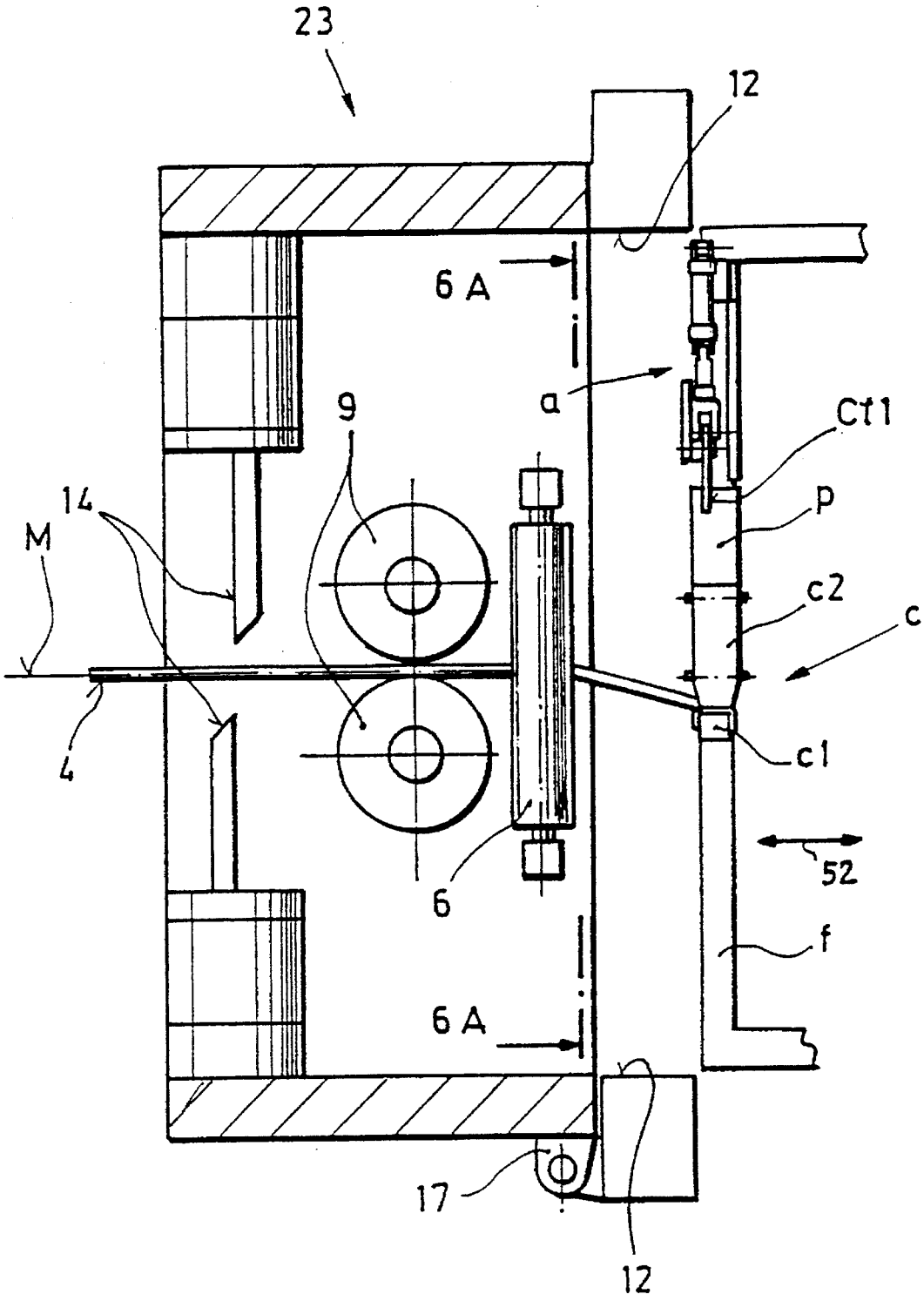
Figure 6A:
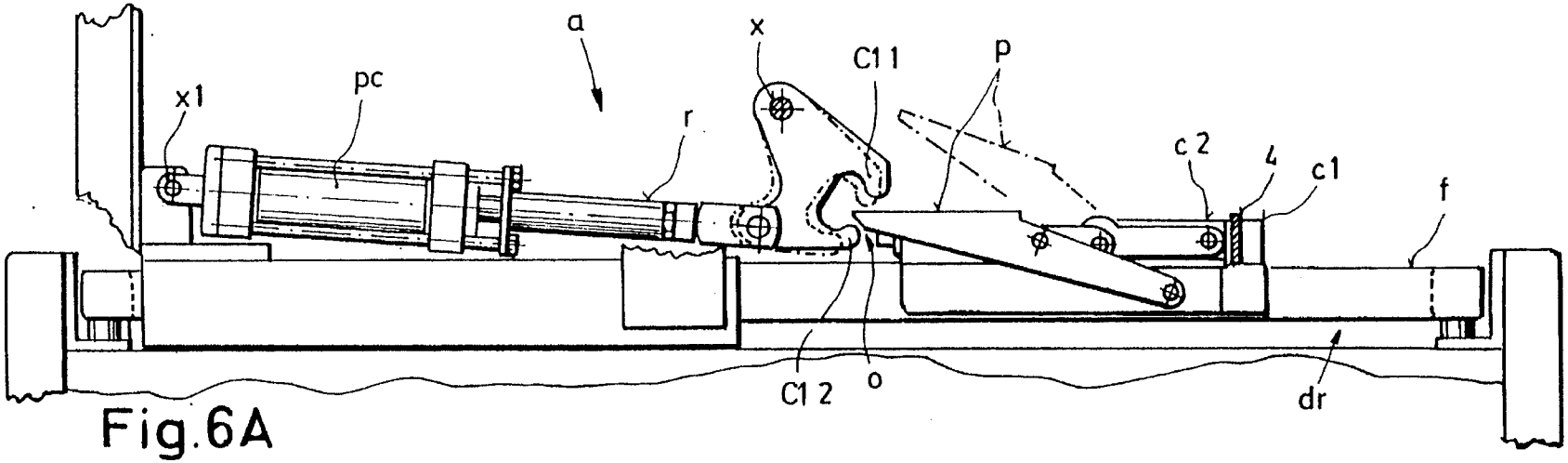
Figure 6B:
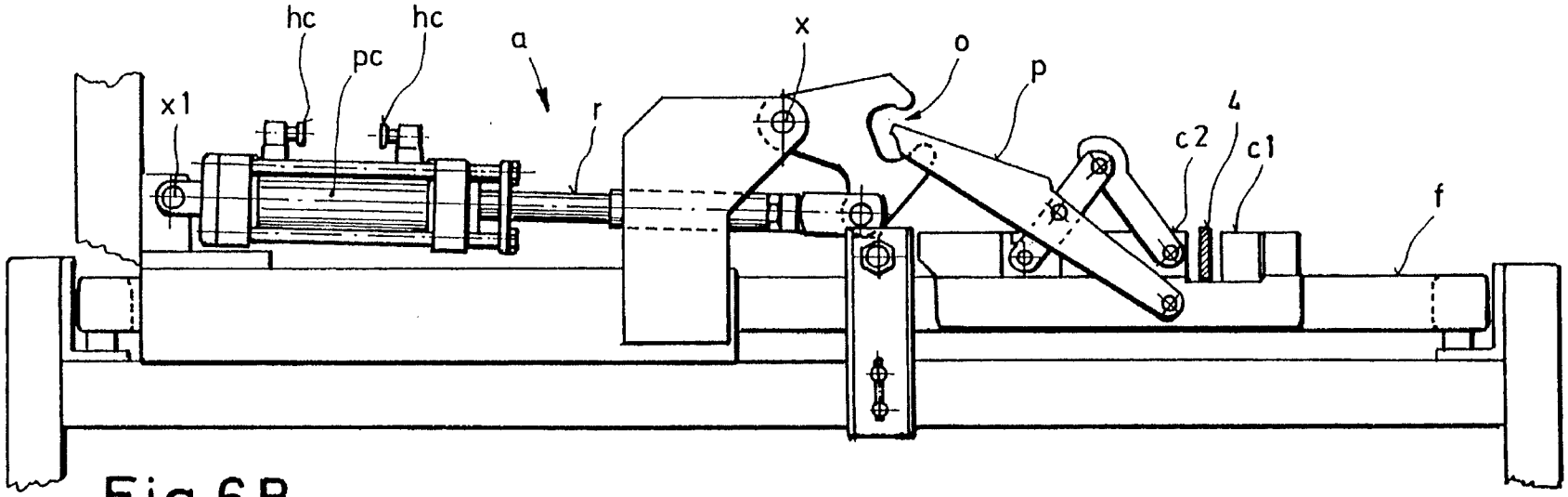
Figure 7:
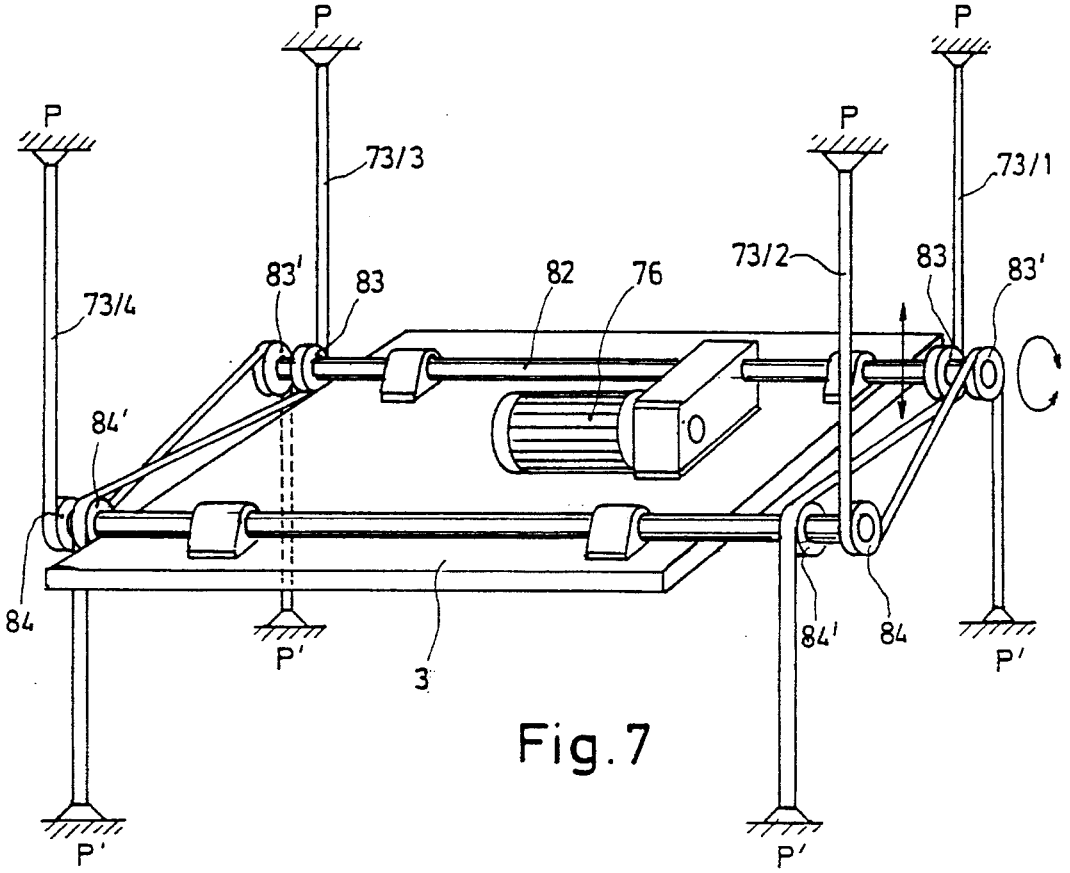
Figure 8:
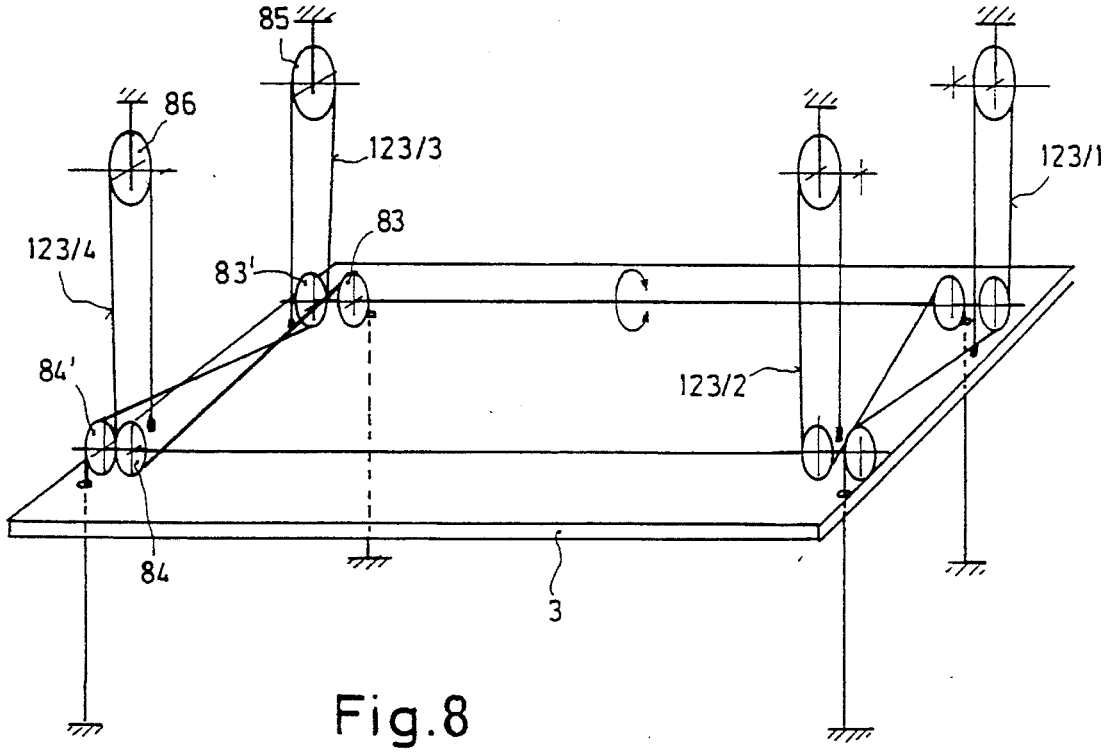
Figure 9:
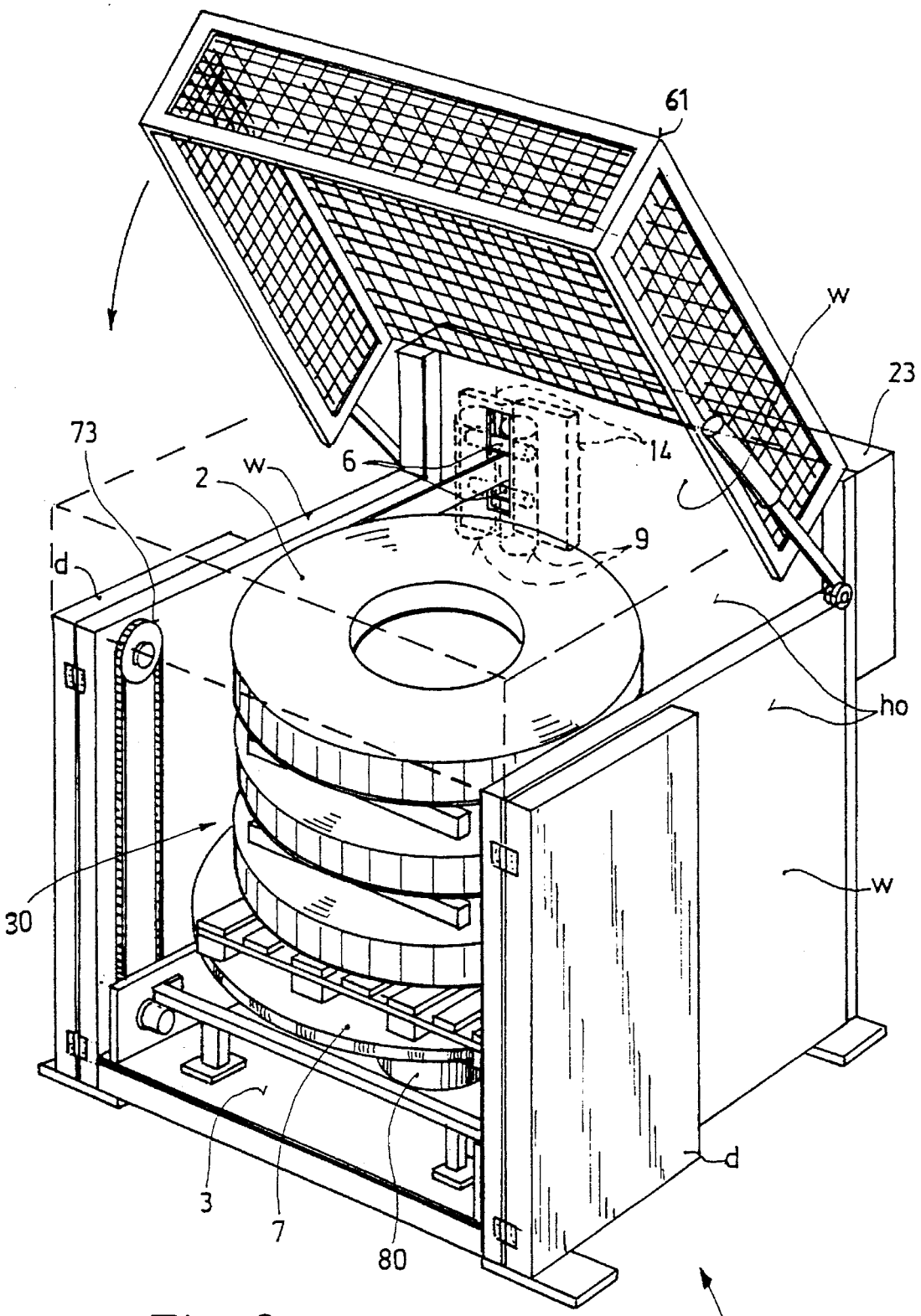

FIG. 6 shows a tool carrier for receiving the band centering unit according to the invention, and, if required, take-off rolls and possibly also shears, all in modular design, in a horizontal section, for which FIG. 6A is an enlarged view of an actuating means for a band clamp taken along line 6A–6A showing the band clamp in a band clamping position, and FIG. 6B is an enlarged view of an actuating means for a band clamp similar to FIG. 6A showing the band clamp in a band releasing position;

FIG. 7 and 8 each show an oblique view of a variant of the lifting means for the coils, and FIG. 9 shows an axonometric view of a preferred embodiment of the unwinding station.

Figure 1:
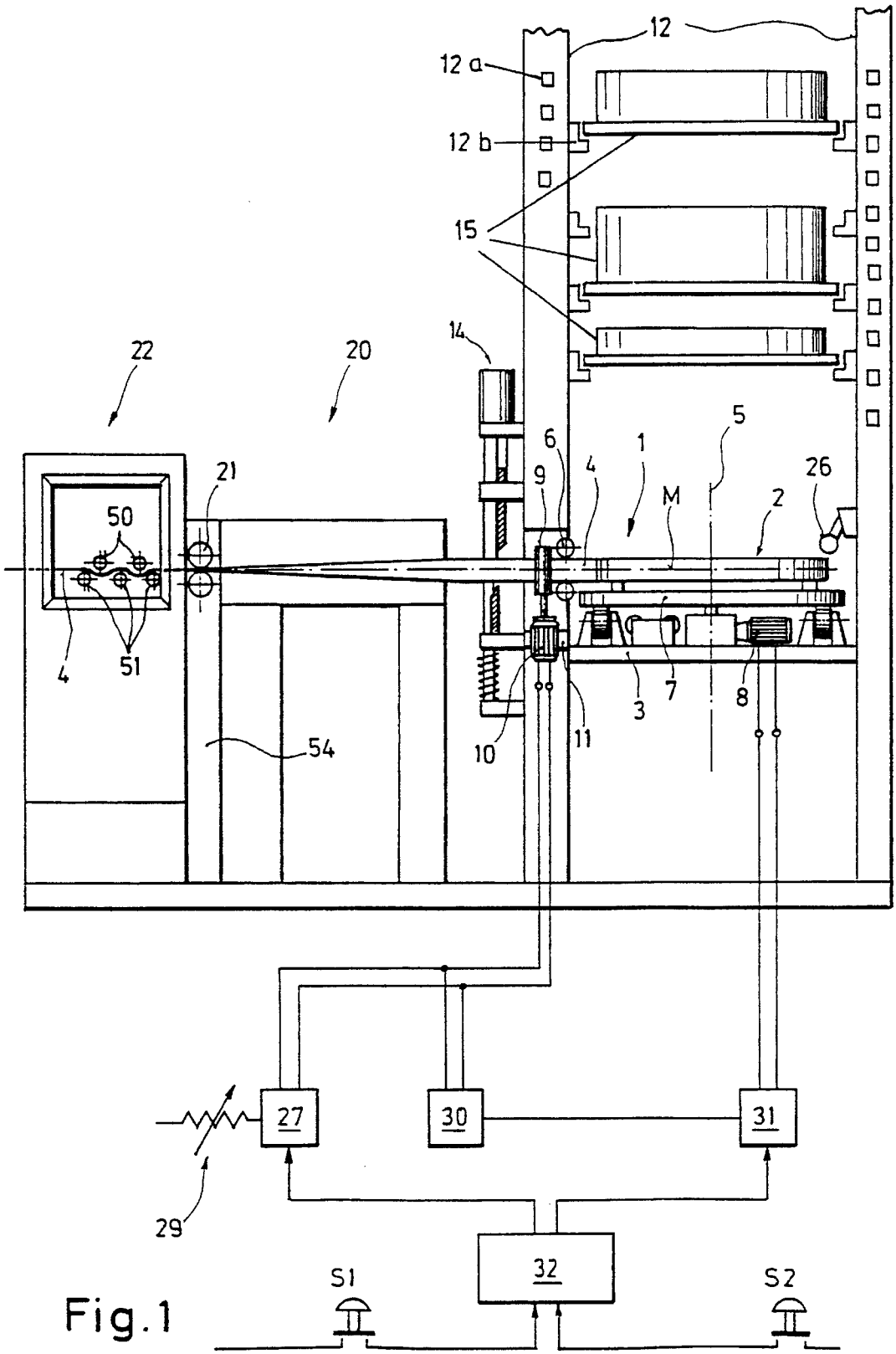
FIG. 1 shows a plant according to the invention for loading with a straightening machine.

According to FIG. 1, the band-like material 4 is fed to a straightening machine 22. This band-like material 4 is unwound from a coil 2 on an unwinding station 1 at the right-hand side of FIG. 1. The band-like material 4 which, as can be seen, lies in a vertical plane from coil 2 onward since the coil is unwound with its axis of rotation 5 vertical, passes through a band transport and turning means 20, which in principle may be similar to that of FIG. 9 of EP-A-0 267 357. The band-like material 4 is aligned on centering rollers 6 beforehand with the middle of intake rolls 21, which—in the direction of movement of the band 4—are downstream of a pair of take-off rolls 9 which may take off directly from coil 2. The take-off rolls 9 (because of the vertical plane of the band at this point) possess vertically oriented axes, whereas the axes of the intake rolls 21, after rotation through 90° by the band transport and turning means 20 connected to the take-off mechanism, are horizontal.

The intake rolls 21 and optionally a vertical pair of centering rollers (not shown)—used here for centering the band 4 in the horizontal plane—are expediently housed in a modular side support 54. These centering rollers are analogous to those in FIG. 5 but of course arranged rotated through 90°.

The band-like material 4 can then, if necessary, pass through a straightening machine 22 which has rollers 50, 51 which straighten the band, and a loop zone (not shown) before the entrance to a processing machine 18, for example a welding machine, in this case a high-frequency punch press (which is distinguished by the arrangement of balancing masses for rapid punching movement and is housed in soundproof housing 19), which loop zone can be replaced by the combined loop and turning zone 24 when the straightening machine 22 is omitted. Each of these loop zones is expediently provided with a light barrier 28 for controlling the loop size. Furthermore, a corresponding loop guide 25, which in general consists of a number of rollers, is coordinated with each loop zone.

The coil 2 is arranged on a lifting stage 3 having a supporting platform. Instead of the lifting stage 3, it is also possible to provide another form of vertically displaceable carriage. A single coil 2, preferably in a cassette known per se and not shown, for example according to U.S. Ser. No. 07/673,778 (filed Oct. 29, 1990), which corresponds to WO 90/09945, which is herewith deemed to have been disclosed, which is taken from a coil store, is present on the turntable 7 arranged on the lifting stage 3; alternatively, however, it is also possible to provide a conventional pallet winch having a plurality of coils which are arranged one on top of the other and are, for example, to be processed as a single order and are therefore processed in succession. An edge sensor 26, expediently for the upper edge of the coil 2, is provided for correct centering at the height of the take-off rolls 9, especially in this case. This does not of course take into account the width of the band-like material on the coil 2, so that this step is virtually only a coarse centering, as is sufficient for pallet winches and has been proposed in DE-B-1,296,475, for example with an optoelectrical converter.

Nevertheless, this coarse centering is sufficient to ensure that minimum handling is required when changing from one coil to another and in fact that this change can even take place automatically. All that is required for this purpose is that the lifting stage is designed for a load of this magnitude and its drive is controlled by the sensor 26. The lifting stage 3 carries the turntable 7, via which the particular coil 2 can be driven in the unwinding and, if required, also the winding direction. The lifting means and unwinding drive form an unwinding station 1 which, in its upper section, can be designed as a magazine for further coils 15.

The unwinding station has at least two, preferably three or four, supports 12 which have catches **12*a* at regular intervals, for example in two vertical rows side by side, as encountered in furniture construction. Retaining elements 12*b*, which support the horizontal cassettes 87 (FIG. 3; also see EP-A-0267357) or underlays 72 (FIG. 1, 3) of the coils 15 (FIG. 1), can be suspended in these locking orifices. As shown in FIG. 1, when applied to the storage of coils this has the advantage that, in the case of coils which are broader than the spacing of the catches 12*a*, there is no need to change the spacing of the retaining elements 12*b* because—as is evident from the higher coils 15 (with broader band material) in FIG. 1—the diameter of the coil is smaller than that of its underlay (this has already been described in EP-A-0 267 357) and is therefore capable of passing between the retaining elements 12*b*. In any magazine file, this middle coil 15** then occupies two positions one on top of the other. This arrangement is of course also advantageous regardless of the centering means described above.

The stated use of supports 12 having a distribution of catches **12*a* (which may optionally also be of a different design) can also be used for converting or expanding an unwinding station. If in fact it is desired to replace a conventional unwinding station, as shown in the stated EP-A-0 267 357, by one having a lifting means, the latter could also be suspended directly in the support 12** without requiring a separate frame.

Of course, the lifting means may be of different designs, for example may also have fluid cylinder units. What is important, however, is that it can be lifted to more than two positions. Thus, it would be possible, for example, to mount three or more hydraulic cylinders on the base of the unwinding station 1, which cylinders engage in the peripheral region or in the area of the edge of lifting stage 3. This in turn has the advantage that tilting during the vertical movement is counteracted, and a satisfactory, horizontal position of lifting stage 3 (which may also be simply in the form of a grid-like stage) is thus also ensured during unwinding-. This prevents the desired, centered position from being disturbed by tilting of the lifting stage 3.

Figure 3:
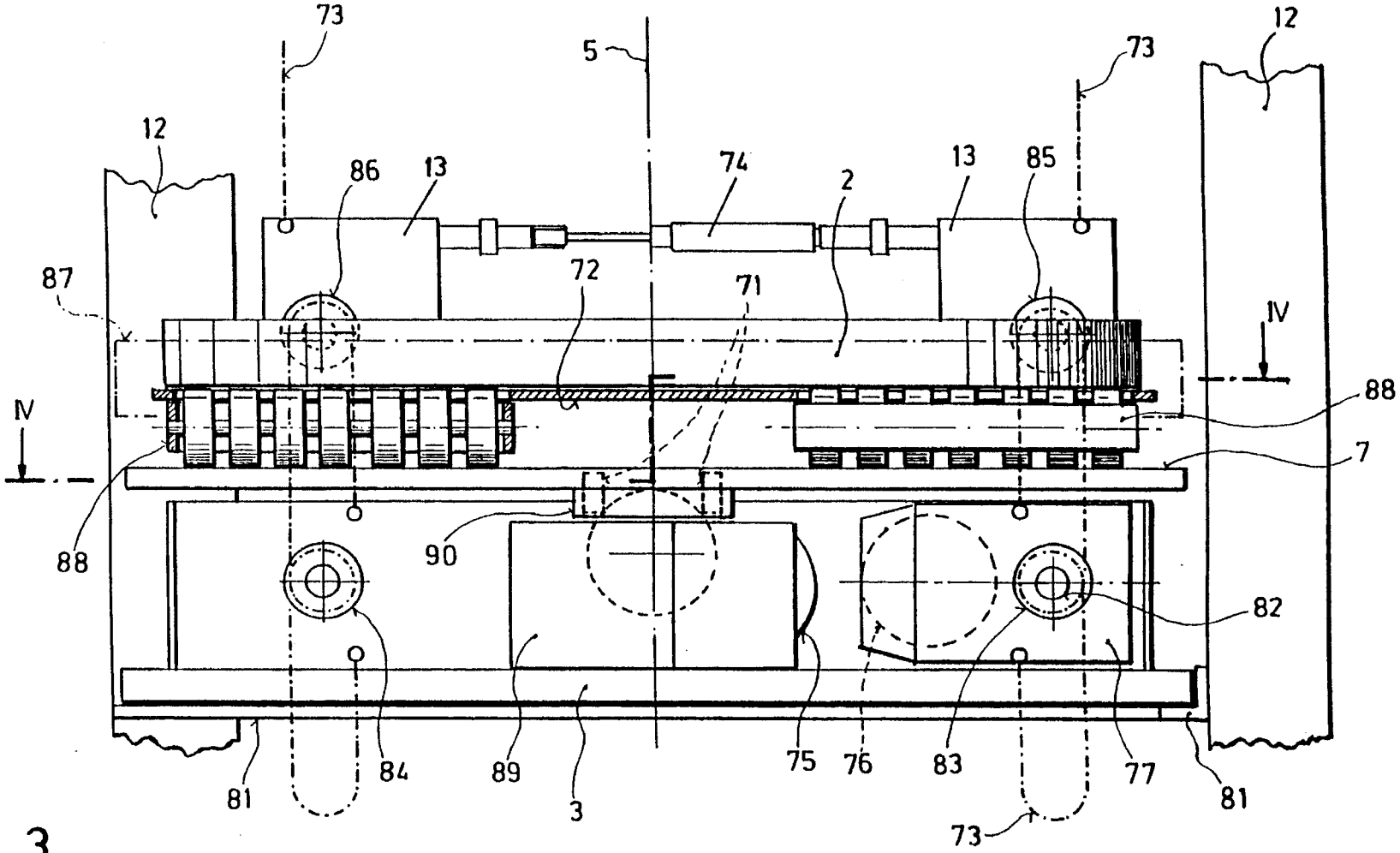
FIG. 3 shows an enlarged view of a detail from FIG. 1 to illustrate a lifting platform, which is shown in FIG. 4 in plan view in two different planes along the line IV—IV of FIG. 3.

However, to permit greater compactness of the design and easier mounting on the perforated supports 12, it is advantageous if the lifting means operates with elongated traction means, such as cables or (preferably) chains 73 and can thus be fastened with the aid of an anchoring bar 74 to the catches **12*a* or, according to FIG. 3, preferably to the blocks 13 firmly connected to the supports 12** or their connecting walls (not shown).

It is also advantageous if at least one drive motor 8 or 76 is arranged on the lifting stage 3 itself. Of these, the motor 8 is intended for driving the turntable 7 while a drive shaft of the lifting means can be driven by the motor 76 via a gear 77 (FIG. 3), so that there is no need for any further installations for mounting such a lifting means. The gear 77 is expediently self-locking, for example in the form of a worm gear. An output cable of the edge sensor 26—as known per se for lift controls—may be in the form of a mechanical sensor with a roll at the end of a lever in order to operate a switch is connected to the motor 76 and its lift control which is not shown and is similar to an elevator control.

Figure 4:
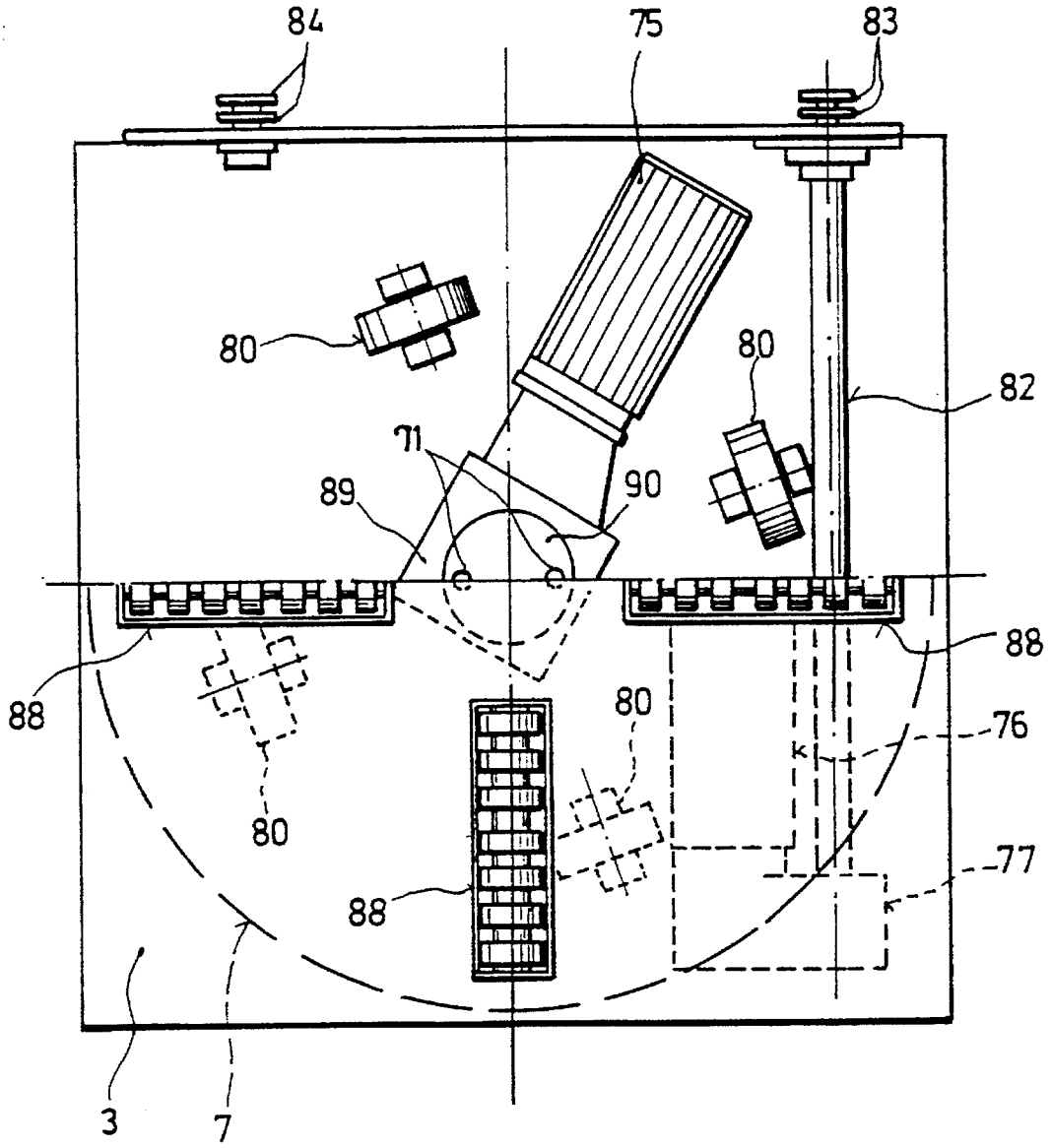

Because of the above-mentioned importance of a tilt-free alignment, it is also advantageous if guide rollers 80 are arranged on the lifting stage 3, in the peripheral region of the turntable 7 (only two thereof are shown in FIG. 4). For easier changing, it is also advantageous if sliding guides 81, in this case in the form of rails, are connected to the lifting means, since it is then merely necessary to push in the lifting stages 3 carrying the essential elements.

Regarding the sliding guides 81, it is clear that they have as little friction as possible—simply in view of the high weight resting on them. Roller guides, as used in drawer guides, are possible, but it is simpler and more stable if they are provided with a low-friction lining, in particular of plastic.

Regarding the chains 73, it is advantageous to arrange them in the manner of a block and tackle, for which purpose two chain wheels 83 are fastened to a drive shaft 82 (FIG. 3, 7), which chain wheels cooperate with deflection wheels 84 on an axle parallel to the shaft 82. Furthermore, according to FIG. 3, further deflection wheels 85, 86 are arranged above these.

Alternatively, instead of straightforward coils, in order also to be able to process coils in cassettes (one is indicated by a dash-dot line in FIG. 3 at 87) which are provided with through-orifices for driving the coil, it is advantageous to use a drive adapter which consists virtually only of a support 72 for a set of rolls 88 shown in FIG. 3 and 4, of which FIG. 3 shows the right one in section and the left one in side view. Each of these rolls adapts to the particular speed of the turntable 87 and transmits it without friction to the coil underlay (not shown) which is located above and carries coil 2 or 15, without there being any need for the inclined conical surfaces requiring a special embodiment of the turntable in the case of conical gear wheels.

A gear box 89, above which is arranged a center bearing 90 with driver pins 71 for the turntable 7 is also coordinated with the rotary drive motor 8. Since, as stated, the band-like material 4 is taken off from the coil in principle with the aid of the take-off rolls 9, the rotary drive 8 for the coil is not absolutely essential; instead, the band 4 can simply be taken off from the rolls 9, similarly to the capstan drive of a tape recorder. However, a preferable procedure is that described in the simultaneously submitted application Ser. No. 07/775, 806 (filed Oct. 11, 1991), "Process for controlling the loading of a processing machine with band-like material and apparatus for this purpose" of the same applicant, which is herewith considered disclosed.

Figure 5:
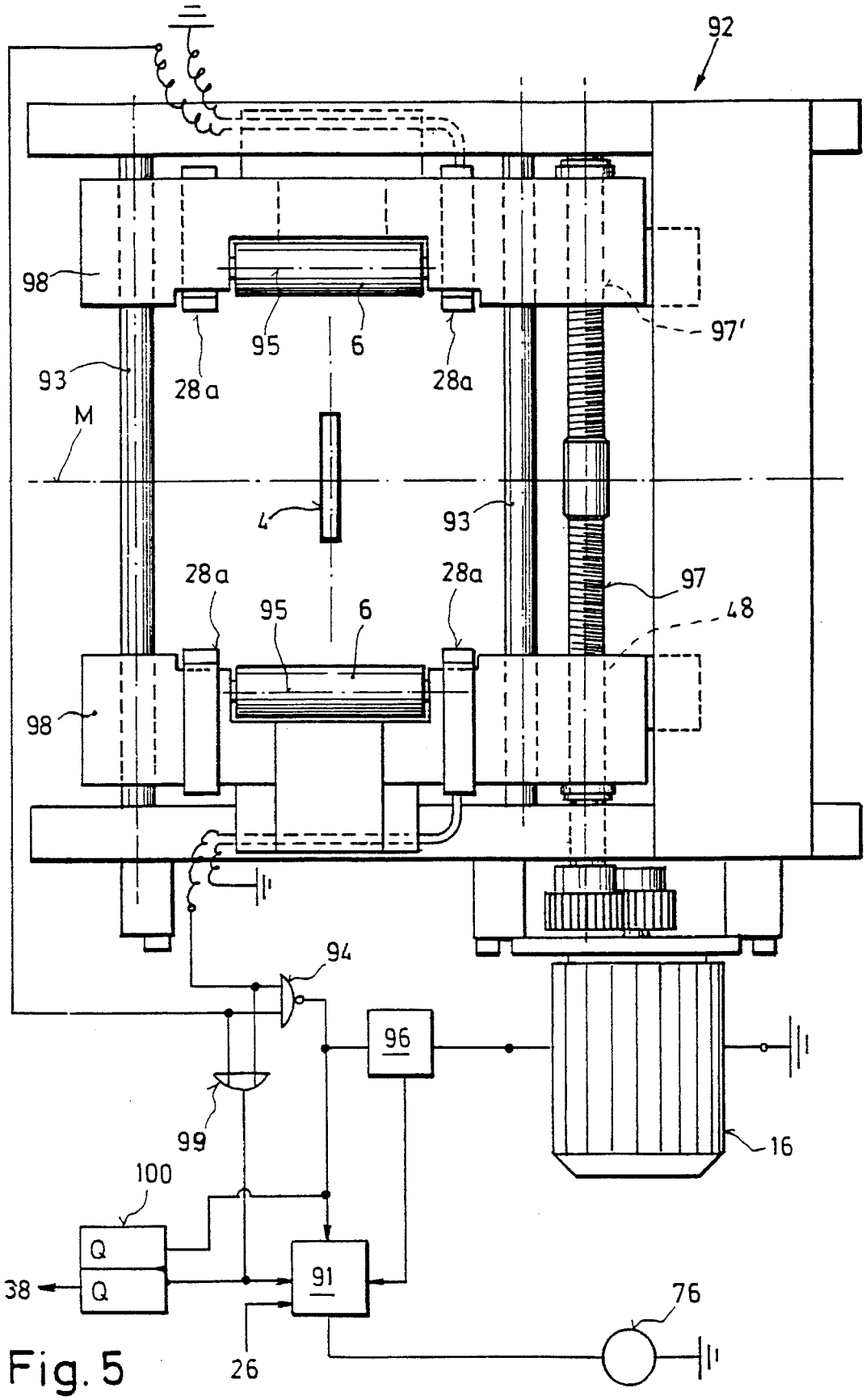
FIG. 5 shows a centering means according to the invention.

According to the invention, the band 4 taken off in a vertical plane from the coil 2 is centered prior to being turned into the horizontal position, as shown in FIG. 5. In this Figure, a frame 92 is provided, on which two guide columns 93 are expediently fastened in the vertical position. As can also be seen, the apparatus shown in FIG. 5 is virtually a measuring means which readjusts the height adjustment of the lifting stage 3 so that the band-like material 4 is unwound at a central level M and in this position.

It would in principle be possible to mount a number of sensors in a row at right angles to the central plane M, for example inductive, capacitive or— preferably—optoelectrical converters. An amplified signal will be obtained at the output of the sensor in whose range the band was actually located in the first-mentioned case, and a reduced signal (or no signal at all) in the latter case, so that the actual width of the band 4 can be calculated from the number of responding sensors. The same effect could be achieved with a single sensor moved at right angles to the central plane M.

However, the preferred embodiment according to FIG. 5 is different. Here, centering surfaces opposite one another, preferably in the form of centering rolls 6, can be moved toward one another with the aid of the drive 16 until they come into contact with an edge of the band 4 and transmit a corresponding signal to the lifting motor 76, which thus lifts the lifting stage 3 to the height corresponding to the centered position until the other centering surface also rests against the opposite edge of the band.

The drive for the centering roll 6 may be of any form, for example also fluidic. However, it is preferable to use a worm 97 which is driven by a motor 16 and has, roughly as far as the central plane M, a left-handed thread on the one side and a right-handed thread on the other. In this way, it is possible to ensure, without complicated synchronization means, that both rolls 6 can move toward one another by the same amount and at the same speed.

Two mobile supports 98, which have, at their right end (based on FIG. 5), a corresponding internal thread 97' engaging the worm 97 and are guided in their movement by the guide columns 93, cooperate with the two thread sections of the worm 97. Each of these carriages 98 carries an axle 95 on which the centering roller 6 is rotatably mounted and hence a longitudinal movement of the band 4, as soon as it rests against the roller, is not hindered. The worm 97 plays the role of a synchronizing means for the movement of the two carriages 98, and it is thus clear that they can be replaced by any other synchronizing means, for example if a separate cylinder drive or motor is coordinated with each carriage 98.

A sensor which travels together with the carriage 98 and in this case is formed—together with a reflector—as light barrier **28*a* is connected to each of the centering rollers 6. If, therefore, the particular carriage 98 travels to the edge of a band 4 to be centered, the light barrier is interrupted at the moment when the roller 6 reaches the associated band edge. The time when the band edge is reached could certainly also be determined by measuring any consequent increase in the current at the motor 16, but this might lead to undesired stresses in the band 4**, and the arrangement shown is therefore more advantageous.

Even if only one of the light barriers is interrupted, the motor 16 and the worm 97 continue to move. Consequently, the centering roller 6 which first arrives at a band edge pushes the band in front of it toward the central plane M. However, these outputs are connected to an EXCLUSIVE OR circuit 99 which emits a signal only when one of the sensors produces a signal, i.e. that which has not yet reached its associated band edge. The output signal of the EXCLUSIVE OR circuit triggers a control stage 91 for the motor 76 of the lifting means, so that the motor 76 begins to rotate when one of the centering rollers 6 reaches the edge. Its speed of rotation or that of the down circuit gear is adjusted so that the lifting means expediently also moves synchronously with the displacement of the band 4 toward the central plane M.

Of course, the reaching of an edge by a centering roller 6 means that the associated coil 2 is in a corresponding plane and therefore has to be displaced accordingly by actuating the lifting means. Only when the second centering roller 6, too, has reached its associated edge is its light barrier signal also absent. Accordingly, a logical element 94 with an AND (an AND circuit in the case of an inductive or capacitive sensor and, as in this case, a NAND circuit in the case of an optoelectrical or pneumatic sensor) informs the control stage 91 of the motor 76 and a control stage 96 for the motor 16 that the centering process has ended, and causes both motors to be switched off. This also ensures fine centering, which in theory can also be realized without the coarse centering by means of the mechanical sensor 26, particularly if the lifting means is not to be displaceable over a plurality of coil widths, i.e. is to be suitable only for holding a single coil. Conversely, the coarse centering described with reference to sensor 26 may be sufficient in many cases. What is important in any case is that the band 4 is freely movable in the region of the centering rollers 6, since otherwise it could only be brought temporarily into the central position.

Figure 2:
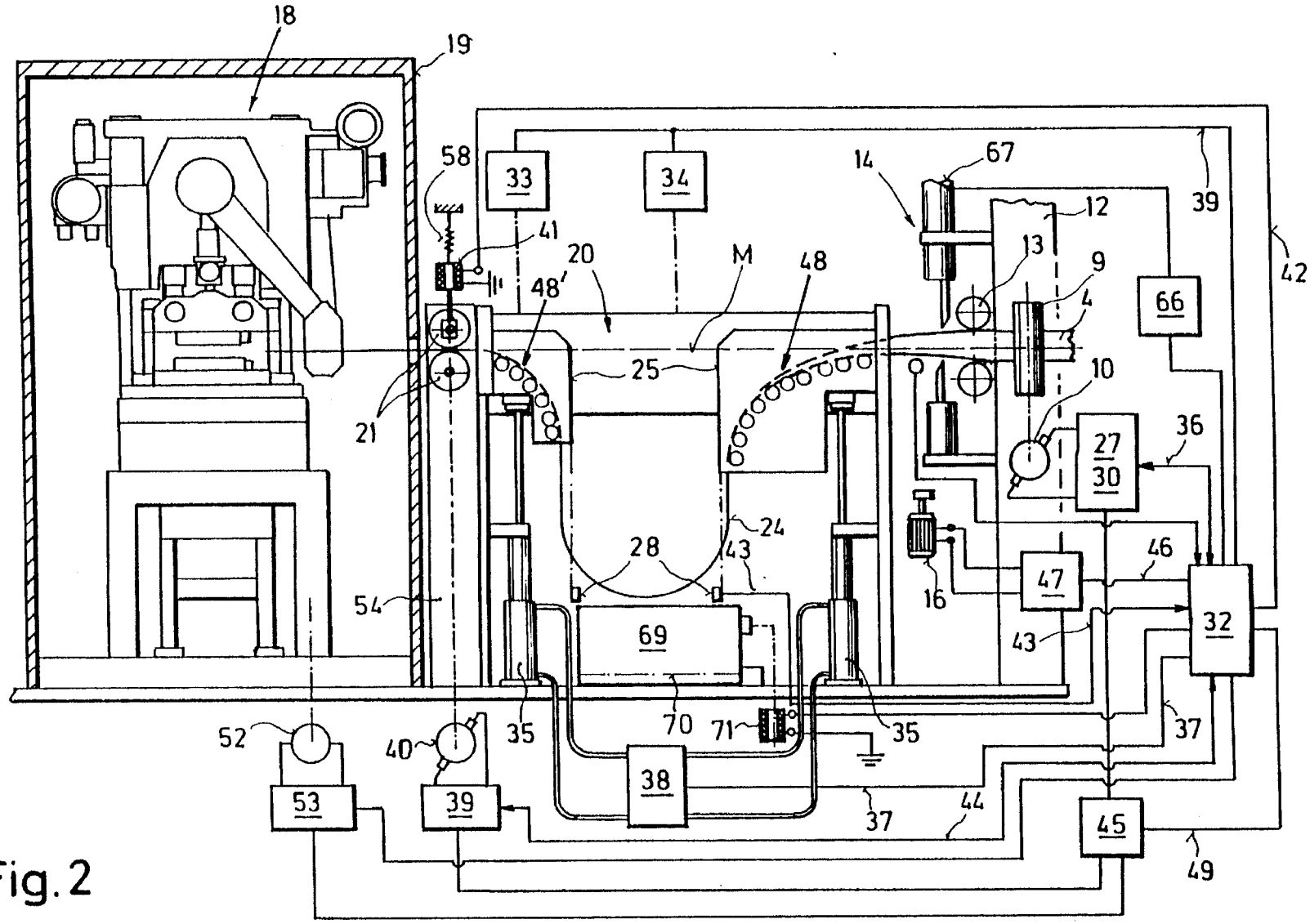
FIG. 2 shows a punch press having a loading apparatus according to the invention and without a straightening machine.

As mentioned above, it is always necessary to provide, before the entrance to the processing machine 18, a loop zone which is preferably in the form of a combined loop and turning zone 24—as shown in FIG. 2— with the loop guides 25. These have an infeed roller cage 48 and an outlet roller cage 48'. The loop zone also has the loop sensor 28, already described with reference to FIG. 2, for the size of the loop. The free mobility in height of this band section for the centering process is ensured, without loss of space or particular measures, by virtue of the fact that the loop zone 24 in which the band 4 rests loosely is downstream of the centering means.

Unconventionally, however, lift drives, in this case expediently in the form of fluidic cylinder units, such as pneumatic cylinders 35, are provided for at least one of the loop guides 25 or roller cages 48, 48', in order to bring at least one of the roller cages 48, 48', in particular both, to the centering position which is to be aligned with the central plane M and is determined by the dimensions of the processing machine 18.

From the statements made above, it is clear that it is advantageous to control the two cylinders 35 together with the other parts of the centering means. For this purpose, the circuit according to FIG. 5 has a flip-flop 100 with its inputs at the outputs of the two logical elements 99, 94, or an analogous trigger circuit, the output Q of which flip-flop or of which trigger circuit is connected to a control stage 38 for the two cylinders 35.

If the EXCLUSIVE OR circuit 99 gives the switch-on signal, the system switches to the output Q, i.e. the control stage 38 having a pilot valve receives the signal which causes this pilot valve to open, whereupon air is fed to the lower end of the cylinders 35. This function requires that the sensor 26 is set so that the lifting stage 3 normally remains slightly below its ideal position corresponding to the central plane M. Otherwise, the circuit described must in practice be duplicated in the sense that corresponding control elements are also present for lowering the lifting means or the roller baskets. The motor 76 must of course have reversible directions of rotation.

However, as soon as the NAND circuit 94 gives the "end" signal, the flip-flop 100 is switched to its output Q, i.e. the output Q switches off and the cylinders 35 remains stationary in the particular position.

A large number of modifications are possible within the scope of the invention; for example, the use of the supports 12 with their locking system, as described above, is also advantageous without a centering apparatus. Of course, the sensor 26 can, if required, be replaced by other sensors such as, for example, a television camera, to which an edge detection circuit is connected, as has been disclosed for a very wide range of purposes, in particular in the form of contrast detection circuits. In this latter case, it would, if required, also be possible to carry out the fine centering with the aid of the lifting means if the central plane M is calculated from the determination of the edges (which may also be effected otherwise than with the television camera).

Regardless of where fine centering is effected, however, it should be noted that the particular embodiment of the lifting means 3, 73–77, in particular with its support on the periphery of the lifting stage 3, ensures much more uniform unwinding and moreover saves space compared with known lifting means having a central reciprocating piston, since in this case there was always the danger of tilting or of a slightly inclined position. In the case of a plurality of spindles, an expensive synchronizing means would be required; in the embodiment preferred according to the invention and having positively synchronous chains, said synchronizing means can be dispensed with.

The above explanations show that it is precisely at the output of the unwinding station 1 that a large number of apparatuses 6, 9, 14 are provided, where they, but where relevant also tape cassette means, should be accessible. In order therefore to improve the accessibility and to permit a modular design consisting of individual units each detachably connected to one another, it is preferable if the pair of take-off rolls 9 and/or a band centering unit 6, 16, 28*a* is fastened to support 12 and can be released from the operating position shown in FIG. 6. In the present case, this is achieved if a carrier 23 is pivotable on a hinge 17, facilitating on the one hand access to the band and the means coordinated with it on the other hand also to the units mounted on the carrier 23, which advantageously also includes the shears 14. In addition, a conventional unwinding station can advantageously be converted into one according to the invention, since all apparatuses are premountable on the carrier 23, which also reduces the delivery times.

This also ensures in particular access to an advantageously provided band clamping means c on a frame (cf. Application WO 90/09945) f embracing the coil (not shown in FIG. 6) together with the turntable and having a stationary clamping jaw c1 and a movable clamping jaw c2. A clamping actuator a coordinated with this band clamping means fastened to the frame is likewise accessible and is shown in more detail in FIG. 6A, 6B in two positions.

The band clamping means according to these Figures differs from that described in WO 90/09945 especially with regard to an extension p of one of the levers of the toggle lever system used. This extension p serves as an actuation projection. However, since the frame f is inserted into a drawer dr in its plane that actuation is effected on the sides of the unwinding station by a clamping actuator a mounted in a stationary manner there, it must be ensured that these two means are correctly coupled to one another.

This may be effected in principle in various ways (for example if the actuating projection p is embraced above and below by surfaces converging in the form of a funnel and is brought into the particular position desired by moving these surfaces). However, a substantially (more) space-saving embodiment is obtained if the clamping actuator a has two claws C11, C12 which are a distance apart to form a coupling orifice o and whose distance apart according to FIG. 6A is such that it corresponds not only to the width of the actuating projection p but furthermore to a tolerance of at least 20%, preferably at least 25%. If the claws C11, C12 and/or the projection p then have a corresponding width in the insertion direction (cf. the double arrow 52 in FIG. 6), so that reliable overlap is ensured in the operating position of the frame f (in FIG. 6, this is ensured by a corresponding width of the projection p), satisfactory functioning is guaranteed under all circumstances.

As evident in particular in FIG. 6B, the claw part is pivotable about a stationary axis x and is brought, by a piston rod r of a piston/cylinder unit pc pivotable about an axis x1 and having fluid connections hc shown in FIG. 6B, from the clamping position evident in FIG. 6A (=the insertion position of frame f) into the open position shown in FIG. 6B, in which position the band 4 lies freely between the jaws c1, c2. FIG. 6A shows that, on further clamping, the claws C11, C12 assume a closed position which is indicated by a dashed line and is somewhat offset with respect to the rest position, indicated by solid lines, for coupling the two parts p and C11, C12 or o, in order reliably to bring the actuating projection p into its clamping position according to FIG. 6A, and on the other hand to take it into the rest position, in which the projection p can be inserted approximately centrally into the orifice o.

FIG. 7 shows that the chain 73 has four different parts 73/1 to 73/4, parts 73/1 and 73/3 on the one hand and the parts 73/2 and 73/4 on the other hand being guided in an analogous manner. Each chain part 73/1 to 73/4 is fastened at one end to a stationary point P above the lifting stage 3 on the support 12 (FIG. 1). The other end of the chain parts 73/1 to 73/4 is fastened to the floor, underneath the lifting stage 3, in each case at a point P'. The chain parts 73/1 and 73/3 run in between (starting from the upper point P), the chain wheel 83 and a deflection wheel 84' which is fastened coaxially with the chain wheel 84 on the shaft of the latter. On the other hand, the chain parts 73/2 and 73/4 run (starting from the upper point P) initially over the chain wheel 84 and are then guided by means of a deflecting wheel 83' arranged coaxially with the chain wheel 83. Of course, good engagement of the chain members with the teeth of the chain wheels must be ensured, since each chain part by itself does not ensure a stable position of the lifting stage 3. Driving with the aid of the motor 76 via the drive shaft 82 is effected by means of the chain wheels 83, from where the movement is also transmitted to the chain wheels 84.

For this reason, it is also possible to use another form of chain guidance, as shown in FIG. 8. There too, four chain parts 123/1 to 123/4 are used, of which the chain parts having an even final digit and those having an uneven final digit are guided in an analogous manner. One end of each of the chain parts 123/1 to 123/4 is fastened to the floor points P' and the other directly to the lifting stage 3. The chain parts 123/1 and 123/3 which run in between are starting from the fastening point of the lifting stage 3, initially upward and over the deflection wheel 85 and then downward. A first deflection wheel 83' is fastened on the lifting stage 3 coaxially with the chain wheel 83, over which deflection wheel the chain parts 123/1 and 123/3 run in a virtually horizontal direction to a further deflection wheel 84' arranged coaxially with the chain wheel 84, and from there downward to point P'.

The chain parts 123/2 and 123/4 run similarly, starting from the fastening point on the lifting stage 3, initially upward to a stationary deflection wheel 86, from where they are guided downward again to the chain wheel 84. After wrapping around the latter through 900, the particular chain part 123/2 or 123/4 then runs approximately horizontally to the driving chain wheel 83 and from there downward to point P'.

This last variant has the advantages of a block and tackle and is therefore preferred.

The problem of accessibility has been discussed above with reference to FIG. 6—6B and the tool carrier 23. However, the problem becomes more critical by virtue of the fact that, in order to avoid the risk of accidents (especially at high unwinding speeds of the heavy coils 2), it is desirable as far as possible to protect the unwinding station from entry and access by unauthorized persons. The problem has been solved to date by placing guard grids all around in known pallet winches; when readily detachable, these do not provide sufficient protection but when difficult to detach made access to the unwinding station more difficult.

According to FIG. 9, a satisfactory solution can now be found if the total unwinding station 101 is placed in a closed housing ho which is formed by walls w and, for example, can be closed by a cover 61 similar to a guard grid. In a preferred arrangement, the takeoff rolls 9 and/or the centering rollers 6, if necessary together with the shears 14, are mounted on one side of the housing ho, expediently in the stated carrier 23, whereas a loading orifice 30 which can be closed by at least one cover, such as the two doors d shown here, is provided on the opposite side, with the result that handling is improved (in comparison with the loading shown in the previous Figures, at right angles to the take-off rolls 9). Furthermore, this embodiment permits the arrangement of such unwinding stations 101 side by side in a row, if necessary interrupted by magazines installed laterally, so that loading of all unwinding stations 101 can take place from a common loading corridor, preferably via controlled handling devices, which simplifies the control of these devices. FIG. 9 shows the use of the unwinding station 101 for known pallet winches having a plurality of coils 2 one on top of the other, but of course, owing to the modular design with units fastened for easy removal, conversion to cassette operation with the stated frame f can easily be performed.

We claim:

1. A method for loading a processing machine with band-like material from a coil, comprising the steps of:

resting said coil substantially horizontally on a turntable with a substantially vertical unwinding axis and unwinding said coil with rotation;

initially holding the plane of said band-like material approximately vertical;

determining the position of the two edges of the unwound, band-like material in order to determine the width of the band-like material;

centering the band-like material at least a first time in order to orient the band-like material with its longitudinal axis horizontally with regard to a central plane which is determined with respect to the dimensions of the processing machine, the height of the coil being adjusted for this purpose; and before the first centering step which effects fine centering relative to said central plane, pre-centering the coil roughly by determining the upper edge of the band-like material, the height of the coil being adjusted for this purpose.

2. A method as claimed in claim 1, further comprising the steps of:

before being loaded into the processing machine, turning and forming the band-like material into a loop in a combined loop and turning zone by means of loop guides; and adjusting the height of at least one of said loop guides in order to orient the centered band plane of the corresponding section of the band-like material relative to said central plane.

3. A method for loading a processing machine with band-like material from a coil, comprising the steps of:

resting said coil substantially horizontally on a turntable with a substantially vertical unwinding axis and unwinding said coil with rotation;

initially holding the plane of said band-like material approximately vertical;

determining the position of the two edges of the unwound, band-like material in order to determine the width of the band-like material;

centering the band-like material at least a first time in order to orient the band-like material with its longitudinal axis horizontally with regard to a central plane which is determined with respect to the dimensions of the processing machine, the height of the coil being adjusted for this purpose;

before being loaded into the processing machine, turning and forming the band-like material into a loop in a combined loop and turning zone by means of loop guides; and adjusting the height of at least one of said loop guides in order to orient the centered band plane of the corresponding section of the band-like material relative to said central plane.

4. An apparatus for loading a processing machine with band-like material from a coil, with the coil resting substantially horizontally on a turntable and having a substantially vertical unwinding axis and from which said band-like material is unwound with rotation, the apparatus comprising:

an unwinding station with a turntable for unwinding the coil;

a band-centering device with at least one sensor for determining the position of at least one edge of the unwound, band-like material and its width, which sensor delivers a corresponding width signal;

a control unit which receives the width signal and controls a lifting device to adjust the height of said coil on its turntable, for centering the band-like material relative to a central plane which is determined with respect to the dimensions of the processing machine; and a band transport and turning system for the band-like material in a turning zone;

wherein said band-centering device further comprises a device for moving said at least one sensor at right angles to the longitudinal direction of the band-like material.

5. An apparatus for loading a processing machine with band-like material from a coil, with the coil resting substantially horizontally on a turntable and having a substantially vertical unwinding axis and from which said band-like material is unwound with rotation, the apparatus comprising:

an unwinding station with a turntable for unwinding the coil;

a band-centering device with at least one sensor for determining the position of at least one edge of the unwound, band-like material and its width, which sensor delivers a corresponding width signal;

a control nit which receives the width signal and controls a lifting device to adjust the height of said coil on its turntable, for centering the band-like material relative to a central plane which is determined with respect to the dimensions of the processing machine;

a band transport and turning system for the band-like material in a turning zone;

two centering rolls in said band-centering device, and devices for adjusting said rolls relative to the opposite edges of the unwound band-like material; and at least one edge position sensor for sensing at least one edge of the band-like material.

6. Apparatus as claimed in claim 5, having two edge position sensors, each being connected to one of the centering rolls and being adjustable therewith, relative to the edges.

7. Apparatus as claimed in claim 5, wherein said two centering rolls are connected to a synchronized drive for synchronization of their movement.

8. An apparatus for loading a processing machine with band-like material form a coil, with the coil resting substantially horizontally on a turntable and having a substantially vertical unwinding axis and form which said band-like material is unwound with rotation, the apparatus comprising:

an unwinding station with a turntable for unwinding the coil;

a band-centering device with at least one sensor for determining the position of at least one edge of the unwound, band-like material and its width, which sensor delivers a corresponding width signal;

a control unit which receives the width signal and controls a lifting device to adjust the height of said coil on its turntable, for centering the band-like material relative to a central plane which is determining with respect to the dimensions of the processing machine; and a band transport and turning system for the band-like material in a turning zone;

wherein said unwinding station comprises at least two supports having catches arranged at intervals for receiving coil-carrying means.

9. Apparatus as claimed in claim 8, wherein a drive adapter for transmitting the rotary speed of the turntable to a coil-carrying underlay is provided on the turntable, the drive adapter having a set of rolls and a support.

10. Apparatus as claimed in claim 8, wherein said coil-carrying means has holding elements for engaging the catches of the supports.

11. Apparatus as claimed in claim 8, wherein the coil-carrying means comprises at least one cassette for carrying a coil.

12. Apparatus as claimed in claim 8, wherein the coil-carrying means comprises at least one underlay for carrying a coil.

13. An apparatus for loading a processing machine with band-like material from a coil, with the coil resting substantially horizontally on a turntable and having a substantially vertical unwinding axis and from which said band-like material is unwound with rotation, the apparatus comprising:

an unwinding station with a turntable for unwinding the coil;

a band-centering device with at least one sensor for determining the position of at least one edge of the unwound, band-like material and its width, which sensor delivers a corresponding width signal;

a control unit which receives the width signal and controls a lifting device to adjust the height of said coil on its turntable, for centering the band-like material relative to a central plane which is determined with respect to the dimensions of the processing machine;

a band transport and turning system for the band-like material in a turning zone; and a loop system having loop guides arranged directly downstream of the band centering device, the height of at least one of the loop guides being adjustable for centering the plane of a corresponding section of the band-like material relative to the central plane, and wherein the sensor of the band centering device delivers a height signal to a height setting control unit for controlling such height setting of the loop guides, which corresponds to a height adjustment of the turntable.

14. An apparatus for loading a processing machine with band-like material form a coil, with the coil resting substantially horizontally on a turntable and having a substantially vertical unwinding axis and from which said band-like material is unwound with rotation, the apparatus comprising:

an unwinding station with a turntable for unwinding the coil;

a band-centering device with at least one sensor for determining the position of at lest one edge of the unwound, band-like material and its width, which sensor delivers a corresponding width signal;

a control unit which receives the width signal and controls a lifting device to adjust the height of said coil on its turntable, for centering the band-like material relative to a central plane which is determined with respect to the dimensions of the processing machine; and a band transport and turning system for the band-like material in a turning zone;

a turning zone in which band transport and turning means for the band-like material is provided, wherein said unwinding station contains the turntable and take-off rolls and includes a closed housing with at least one loading orifice for being covered by at least one housing closing element.

15. An apparatus for loading a processing machine with band-like material form a coil, with the coil resting substantially horizontally on a turntable and having a substantially vertical unwinding axis and form which said band-like material is unwound with rotation, the apparatus comprising:

an unwinding station with a turntable for unwinding the coil;

a band-centering device with at least one sensor for determining the position of at least one edge of the unwound, band-like material and its width, which sensor delivers a corresponding width signal;

a control unit which receives the width signal and control sa lifting device to adjust the height of said coil on its turntable, for centering the band-like material relative to a central plane which is determined with respect to the dimensions of the processing machine;

a band transport and turning system for the band-like material in a turning zone; and a frame surrounding the turntable and band clamping means on the frame, with a clamping actuator with two actuation claws opposite one another, forming a coupling orifice for receiving an actuating projection of the band clamping means.

16. Apparatus as claimed in claim 15, wherein said coupling orifice has a width corresponding to a width of said actuating projection plus a tolerance of at least 25%.

17. An apparatus for loading a processing machine with band-like material from a coil, with the coil resting substantially horizontally on a turntable and having a substantially vertical unwinding axis and from which said band-like material is unwound with rotation, the apparatus comprising:

an unwinding station with a turntable for unwinding the coil;

a band-centering device with at least one sensor for determining the position of at least one edge of the unwound, band-like material and its width, which sensor delivers a corresponding width signal;

a control unit which receives the width signal and controls a lifting device to adjust the height of said coil on its turntable, for centering the band-like material relative to a central plane which is determined with respect to the dimensions of the processing machine; and a band transport and turning system for the band-like material in a turning zone;

wherein the band centering device is arranged on a modular tool carrier in the immediate vicinity of the turntable and independently of the turntable, forming a unit which can be released form and secured in an operating position.

18. Apparatus as claimed in claim 17, wherein said tool carrier further comprises a modular shearing device for cutting said band-like material.

* * * * *